US008531127B2

(12) United States Patent
Smith et al.

(10) Patent No.: US 8,531,127 B2
(45) Date of Patent: Sep. 10, 2013

(54) COMPUTER CONTROLLED POWER SUPPLY ASSEMBLY FOR A LED ARRAY

(75) Inventors: Richard F. M. Smith, Upland, CA (US); Richard H. Cockrum, Upland, CA (US); James S. Kang, Rancho Cucamonga, CA (US); Phyllis R. Nelson, Mt Baldy, CA (US)

(73) Assignee: Cal Poly Pomona Foundation, Inc, Pomona, CA (US)

( * ) Notice: Subject to any disclaimer, the term of this patent is extended or adjusted under 35 U.S.C. 154(b) by 362 days.

(21) Appl. No.: 13/030,210

(22) Filed: Feb. 18, 2011

(65) Prior Publication Data

US 2011/0204801 A1 Aug. 25, 2011

Related U.S. Application Data

(60) Provisional application No. 61/307,551, filed on Feb. 24, 2010.

(51) Int. Cl.
*H05B 37/02* (2006.01)

(52) U.S. Cl.
USPC ..... 315/291; 315/224

(58) Field of Classification Search
USPC ..... 315/209 R, 224–226, 291, 307
See application file for complete search history.

(56) References Cited

U.S. PATENT DOCUMENTS

| | | | | |
|---|---|---|---|---|
| 5,661,645 | A | 8/1997 | Hochstein | |
| 6,320,330 | B1 | 11/2001 | Haavisto et al. | |
| 6,329,760 | B1 | 12/2001 | Bebenroth | |
| 7,071,762 | B2 | 7/2006 | Xu et al. | |
| 8,093,822 | B2 * | 1/2012 | Liu | 315/224 |
| 8,217,588 | B2 * | 7/2012 | McKinney | 315/291 |
| 2007/0222399 | A1 * | 9/2007 | Bondy et al. | 315/291 |
| 2012/0223649 | A1 * | 9/2012 | Saes et al. | 315/186 |

* cited by examiner

*Primary Examiner* — Jimmy Vu
(74) *Attorney, Agent, or Firm* — James G. Passé; Passé Intellectual Property, LLC

(57) ABSTRACT

The present invention consists of a power supply and LED circuit arrangement for powering LED arrays such that single or multiple LED failures will have minimal affect on the utility of the LED array. The power supply consists of an analog or microcontroller-based feedback module with single/multiple feedback signals in series with a synchronous buck-boost converter followed by an optional filter and a LED array. The assembly utilizes the feedback signal, to modulate various parameters of the LED array, such as the output intensity, LED junction temperature, and chromaticity. The power supply can drive different circuit arrangements of LEDs including series, parallel, and combinations thereof. Typical feedback signals include LED current, temperature, and ambient luminance and contrast.

6 Claims, 3 Drawing Sheets

COMPUTER CONTROLLED POWER SUPPLY ASSEMBLY FOR A LED ARRAY

This application claims priority of U.S. provisional application No. 61/307,551 filed on Feb. 24, 2010 and is included herein in its entirety by reference.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to a computer controlled power supply assembly for LED array. In particular, the present invention relates to a feedback system for regulating the DC power supply to a LED array.

2. Description of Related Art

Most, if not all textbooks make the point of saying that LEDs should not be operated in parallel unless large series resistors are used to prevent over current. Series arrays can require several hundred volts for large arrays. For example, a series array consisting of 500 LEDs conceivably requires a voltage of 1000 volts, whereas the same LEDs arranged in a parallel array could operate at 2 volts.

LED arrays are used in vehicle traffic control signal heads and other larger industrial arrays, such as those used by banks to display the temperature to passing motorists.

Manufacturers of LED arrays are using a technique called "binning" which, in addition to better quality control, has resulted in more uniform properties of LEDs. A practice used by some manufacturers is a simple series configuration of the LEDs. In this mode of operation, the failure of one LED will cause the entire series string to extinguish, and for large strings, the drive voltage can be several hundred volts which can pose a safety hazard. Combination series-parallel circuits also require large voltages and a single failure will extinguish the series string. This type of failure is readily visible in many traffic control signal heads. The increase in efficacy of LEDs can be lost when an efficient drive circuit is not employed. A wide variety of drive circuits are being used by present manufactures. An ideal LED drive circuit should be capable of driving red, green, and yellow LED arrays and directional arrows with only minor modifications to the feedback control circuitry.

Manufactures have approached maximizing the power delivery to LED arrays in a number of ways. U.S. Pat. No. 5,661,645 describes a power supply for a light emitting diode array which includes a circuit for interrupting the supply of power from the power supply to the LED array. This increases the transient currents to the LEDs reducing life. Also, included are ballast resistors in series with the LEDs to limit current. This severely reduces efficiency. The patent claims that typical power levels are 14 watts for an 8 inch traffic control signal head. U.S. Pat. No. 6,320,330 describes an electronic device suitable for only two series LEDs. U.S. Pat. No. 6,329,760 describes a circuit arrangement for pulsing or flashing a LED. This circuit is not applicable to large arrays that must be on continuously.

U.S. Pat. No. 7,071,762 describes a power supply assembly for a LED lighting module that supplies a constant current to a LED lighting module, by using low frequency pulse width modulation PWM. This circuit is inherently hazardous because of the large voltages required to drive large LED arrays. It also reduces LED life because of the high pulsed currents required to get an average current that does not exceed the manufacture's rated current. As the pulse width decreases in time, the current pulses increase in amplitude in order to maintain a constant current.

Currently, there is no system that allows the use of parallel LED arrangements without the use of large series resistors.

BRIEF SUMMARY OF THE INVENTION

It has been discovered that it is possible to provide a constant DC voltage to a LED array, either in series or in parallel, regardless of the size of the LED array without the use of large series resistors. It is now possible to provide a circuit that can easily be modified to accommodate any of the modern LEDs that range in voltage from 1.5 to voltages larger than 3 volts and with currents ranging in the low milliamperes to several amperes in regulated manner to provide variable DC voltage under constantly changing conditions and eliminate the need for use of large series resistors.

For a given LED type, the same power supply can be used for small arrays of 10 LEDs and large arrays of 200 LEDs without any modifications or resisters, making it applicable to either 8 inch traffic control signal heads, 12 inch traffic control signal heads, or large display signs. A typical time and temperature display sign used by commercial establishments use several thousand LEDs. Power can be supplied by either a battery or AC power which has been rectified and filtered.

In particular, one embodiment of the invention is a regulated power supply assembly for providing variable DC voltage to a parallel, series, or combination thereof LED array comprising:

a) an analog or microcontroller feedback module which receives one or more feedback signals from at least one feedback signal generator connected to the LED array and delivers a scaled voltage based on comparing the one or more feedback signals with predetermined array operating conditions for those feedback signals wherein a plurality of signal conditioners scale the feedback signals input to the feedback module;

b) a synchronous buck-boost converter which receives the scaled voltage from the feedback module and delivers voltage to the LED array whose voltage amplitude is based on the scaled voltage received from the feedback module;

c) a low pass filter between the synchronous buck-boost converter module output and the LED array; and d) a power source for powering the assembly.

Another embodiment of the present invention is a means for generating an alarm signal for voltage or current out of specifications.

DETAILED DESCRIPTION OF THE INVENTION

Figure 1:
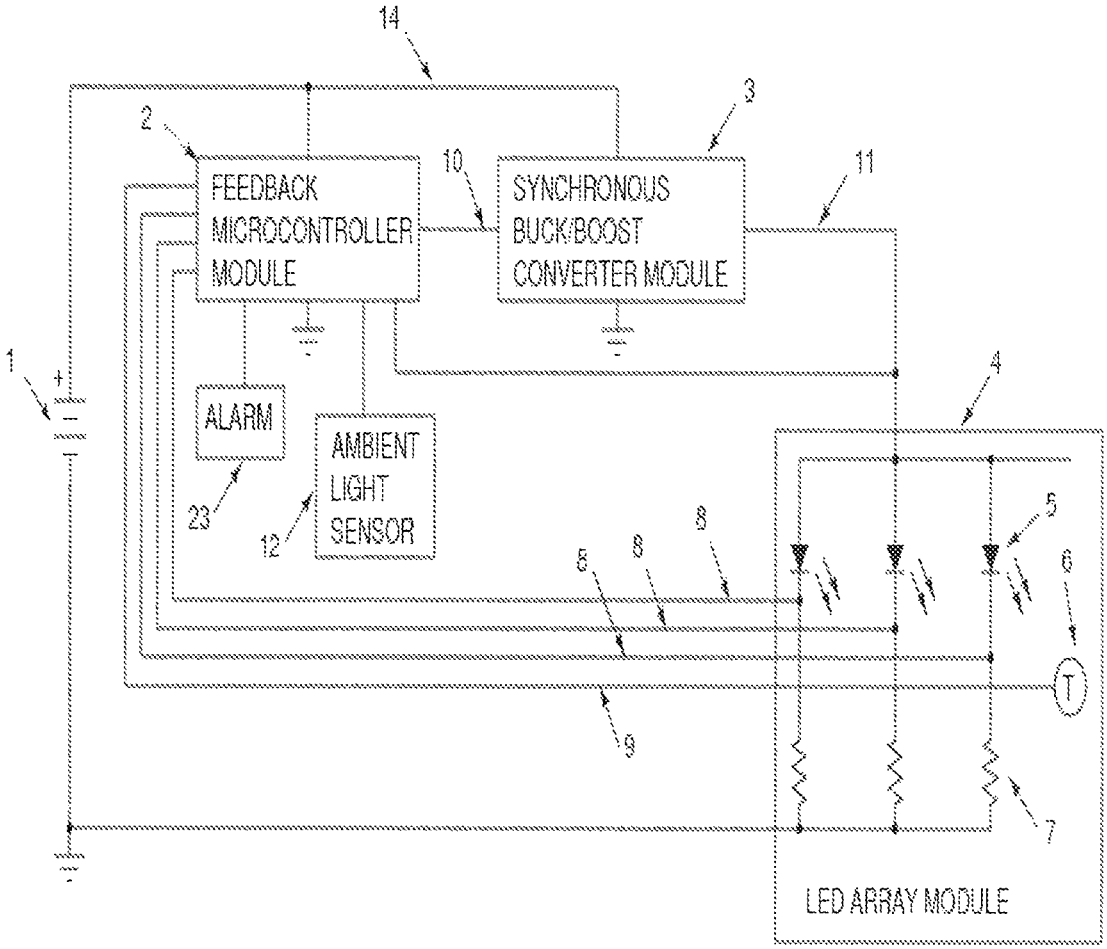
FIG. 1 is a block diagram showing an example of the present invention power supply in use with a LED array

While this invention is susceptible to embodiment in many different forms, there is shown in the drawings and will herein, be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

Definitions

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein, is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein "an analog or microcontroller feedback module" refers to a device that can be programmed to accept a feedback signal about a condition of the LED array such as current, temperature, brightness, the ambient light by the array, or the like, from a feedback signal generator, such as digital temperature sensors, or current, brightness, ambient light, current, or other sensing device with a digital output that can be analyzed by the feedback module. The feedback module takes the information from one or more of the feedback signals and compares it with predetermined operating conditions for the particular array. It can then determine what changes to the DC voltage and to the LEDs would need to be sent to the LED array to keep it in the desired operating parameters. Once that is determined, the feedback module will send a scaled voltage to a synchronous buck-boost converter. The buck-boost converter then takes the scaled voltage and delivers a DC voltage to the LED whose voltage amplitude is based on the scaled voltage received. A buck-boost converter delivers the variable DC voltage to a parallel series of combination thereof LED array with a low pass filter in the line.

A "feedback signal generator" as used herein, is a digital device for measuring an operating parameter of the LED array and sending the information digitally by signal to a desired location, in this invention, the feedback module. These types of feedback module devices are well known and include digital sensors for current, temperature, LED brightness, ambient light, or the like. All these operating parameters can be qualified measurements of the operating conditions of the LED array and thus the voltage necessary to keep the LED in proper operating parameters. The operating parameters of a LED array are well known and manipulated by the present invention to adjust the DC voltage to the array.

The system of embodiment shown in FIG. 1 comprises a source of DC voltage 1 connected for communicative relationship via line 14 to feedback microcontroller module 2 and synchronous buck/boost converter module 3. LED module 4 communicates with feedback microcontroller module 2 by means of current feedback signals 8 and temperature feedback signal 9. Feedback microcontroller module 2 communicates with synchronous buck/boost converter module via line 10. Line 10 provides a scaled voltage to the synchronous buck/boost converter module whose amplitude depends upon the type of LEDs in the LED module, the current rating of the LEDs, the operating conditions desired, and the desired operating temperature of the LED module 4. Resistors 7 operate as current shunt measurement sensors. The size of the resistors 7 depends upon the power rating and the type of the LEDs 5. Temperature sensor 6 communicates to the feedback microcontroller module 2 via line 9. Temperature is a critical factor that must be taken into consideration, especially, for high power LEDs and for LED arrays operating under high/low ambient temperature conditions. Feedback microcontroller module 2 should be located as close as possible to synchronous buck/boost converter module 3 in order to minimize noise pickup on line 10. LED module 4 may consist of any combination of parallel or series LEDs. Output from synchronous/boost converter module 3 via line 11 to feedback controller 2. Output from the synchronous/boost converter module 3 via line 11 to LED module 4 provides a constant output voltage whose amplitude depends upon the operating conditions set by the end user and incorporated into an algorithm in the microcontroller. An optional ambient light sensor 12 for providing ambient lighting feedback and an alarm 23 for signaling a failure is also shown.

Figure 2:
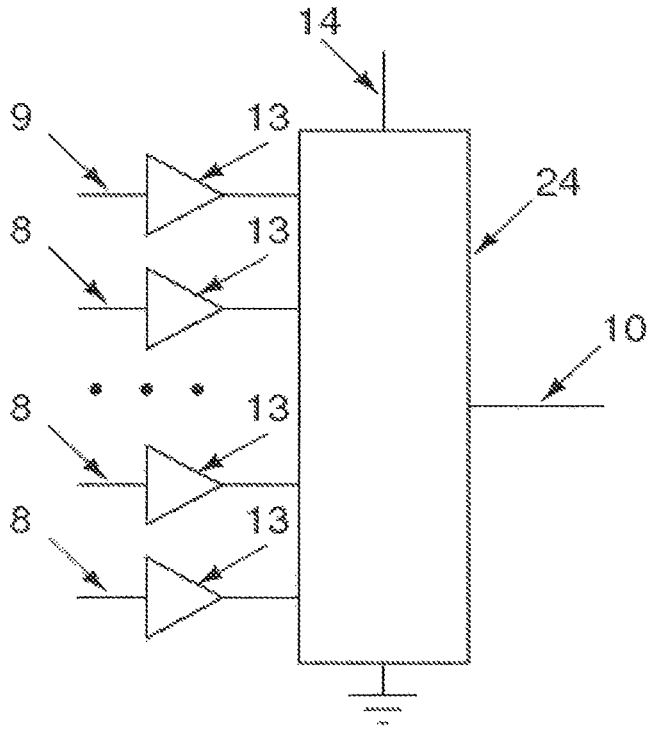
FIG. 2 is a diagram of the feedback microcontroller module.

FIG. 2 shows a block circuit diagram of the feedback microcontroller module 2. The voltage output from resistors 7 of FIG. 1 is a differential voltage proportional to current through a LED 5. The differential voltage is applied to the input of a common-mode voltage difference amplifier whose output can be scaled to match the type of LEDs 5 (shown in FIG. 1) being used. This voltage is in turn applied to the analog input channels of the microprocessor 24. Output 10 from the microprocessor 24 is connected for communicative relationship to synchronous buck/boot controller 23 located in the synchronous buck/boot converter module 3. A properly conditioned feedback signal via output line 10 is necessary for stability of synchronous buck/boost converter module 3.

Figure 3:
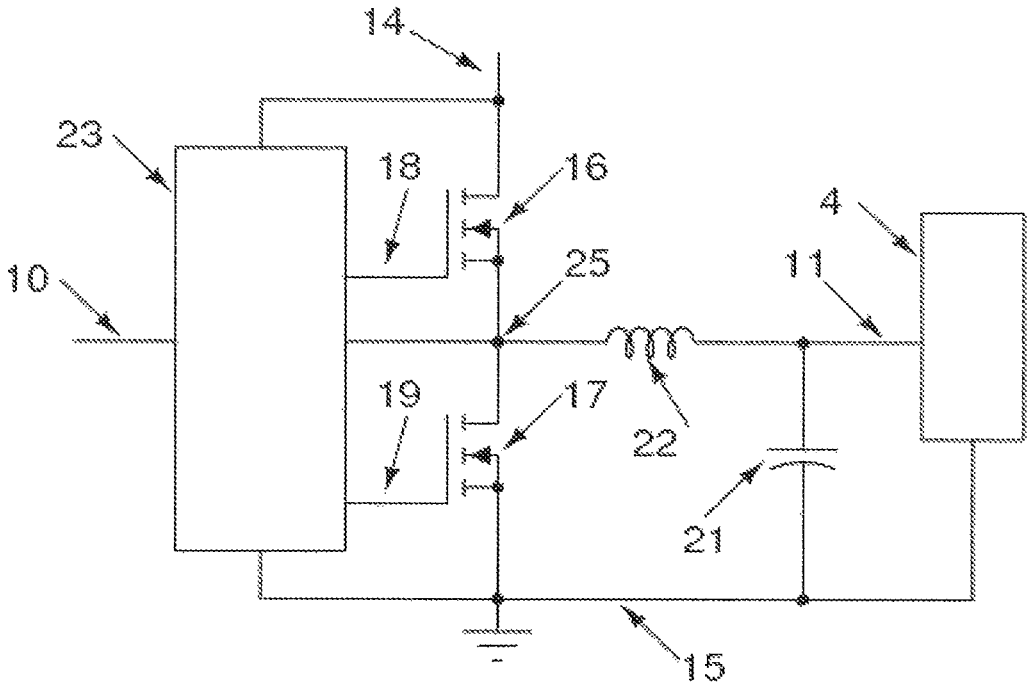
FIG. 3 is a diagram of the synchronous buck/boost module.

FIG. 3 shows a diagram of the synchronous buck/boost converter module 3. Synchronous buck-boot controller 23 controls the gate signals to the high side field effect transistor 16 and low side field effect transistor 17, using a fixed frequency voltage mode. The controller 23 must use an anti-cross conduction scheme to prevent both the high side 16 and low side 17 transistors from being turned on, simultaneously, thus preventing shoot through current which will destroy the field effect transistors 16 and 17. Line 25 provides feedback for the anti-cross conduction scheme in converter 3. Inductor

22 and capacitor 21 form a low pass filter. Field effect transistor 17 provides a path for the inductor 22 current when transistor 16 is switched off. Sometimes this transistor 17 is replaced by a high speed diode. The output voltage 11 from the low pass filter is input to the LED array module 4. Careful design will allow the LED array to consist entirely parallel LEDs 7. The advantage of the parallel array over a series array is that a defective LED will not cause the entire array to go off.

What is claimed is:

1. A regulated power supply assembly for providing variable DC voltage to a parallel, series or combination thereof light emitting diode (LED) array comprising:

a) an analog or microcontroller feedback module which receives one or more feedback signals from at least one feedback signal generator connected to the LED array and delivers a scaled voltage based on comparing the one or more feedback signals with predetermined array operating conditions for those feedback signals wherein a plurality of signal conditioners scale the feedback signals input to the feedback module;

b) a synchronous buck-boost converter which receives the scaled voltage from the feedback module and delivers voltage to the LED array whose voltage amplitude is based on the scaled voltage received from the feedback module;

c) a low pass filter between the synchronous buck-boost converter module output and the LED array; and d) a power source for powering the assembly.

2. The power supply according to claim 1 wherein the at least one feedback signal generator connected to the LED array is selected from the group comprising:

i. at least one of a LED current sensor;

ii. at least one of an ambient light sensor;

iii. at least one of a LED array temperature sensor; and iv. at least one of a LED brightness sensor.

3. The power supply according to claim 1 wherein at least a portion of the LED array is in parallel.

4. The power supply according to claim 1 wherein there is a filter for removing ripple from the output of the synchronous buck-boost converter.

5. The power supply according to claim 1 wherein voltage to the array is limited for voltage or current out of specifications.

6. The power supply according to claim 1 wherein there is a means for generating an alarm signal for voltage or current out of specifications.

* * * * *